US008581501B2

(12) United States Patent
Shertok et al.

(10) Patent No.: US 8,581,501 B2
(45) Date of Patent: Nov. 12, 2013

(54) FLUORESCENT DIMMING BALLAST WITH IMPROVED EFFICIENCY

(75) Inventors: Avi Shertok, Cincinnati, OH (US); Bruce Roberts, Mentor-on-the-Lake, OH (US)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 12/543,125

(22) Filed: Aug. 18, 2009

(65) Prior Publication Data

US 2010/0134035 A1 Jun. 3, 2010

(51) Int. Cl.
*H05B 41/36* (2006.01)

(52) U.S. Cl.
USPC ..... 315/158; 315/224; 315/247; 315/272; 315/291; 315/307

(58) Field of Classification Search
USPC ..... 315/224, 225, 291, 219, 307, 308, 315/209 R, 244, 247, 276, 208
See application file for complete search history.

(56) References Cited

U.S. PATENT DOCUMENTS 4,358,710 A 11/1982 Magai
4,388,566 A 6/1983 Bedard et al.
4,604,552 A 8/1986 Alley et al.
4,704,563 A 11/1987 Hussey
4,928,038 A 5/1990 Nerone
5,317,237 A 5/1994 Allison et al.
5,668,446 A * 9/1997 Baker ..... 315/294
5,701,059 A 12/1997 Steigerwald et al.
5,703,441 A 12/1997 Steigerwald et al.
5,751,115 A * 5/1998 Jayaraman et al. ..... 315/225
5,872,429 A * 2/1999 Xia et al. ..... 315/194
5,910,709 A 6/1999 Stevaocic
5,965,985 A 10/1999 Nerone
6,046,550 A * 4/2000 Ference et al. ..... 315/291
6,175,198 B1 1/2001 Nerone
6,218,788 B1 4/2001 Chen et al.
6,339,298 B1 1/2002 Chen
6,348,767 B1 2/2002 Chen et al.
6,392,366 B1 5/2002 Nerone
6,628,091 B2 * 9/2003 Griffin et al. ..... 315/291
6,771,029 B2 * 8/2004 Ribarich et al. ..... 315/292
7,061,189 B2 * 6/2006 Newman et al. ..... 315/291
7,075,251 B2 7/2006 Chen et al.
7,279,854 B2 * 10/2007 Nerone ..... 315/307
7,816,872 B2 * 10/2010 Nerone et al. ..... 315/224
2002/0101193 A1 8/2002 Farkas et al.
2006/0119295 A1 * 6/2006 Ahn et al. ..... 315/320
2007/0176883 A1 * 8/2007 Hsu et al. ..... 345/102
2009/0147176 A1 6/2009 Kron et al.

* cited by examiner

*Primary Examiner* — Shawki Ismail
*Assistant Examiner* — Christopher Lo
(74) *Attorney, Agent, or Firm* — Fay Sharpe LLP

(57) ABSTRACT

Dimming ballasts and methods are presented for powering a plurality of fluorescent lamps in which at most one of the lamps is selectively dimmed while all the remaining lamps are turned on or off according to a dimming level setpoint to allow dimming to match a user's desired lighting level while maintaining high efficiency.

7 Claims, 7 Drawing Sheets

FLUORESCENT DIMMING BALLAST WITH IMPROVED EFFICIENCY

BACKGROUND OF THE DISCLOSURE

Dimmable ballast systems provide varying levels of light output through a variety of means. For multi-lamp fixtures, conventional dimming ballast techniques include discrete dimming (so-called "step-dimming") and continuous dimming. One example of discrete dimming is a multiple-lamp discrete ballast in which one or more lamps are shut off to provide a lower light output. This is sometimes implemented using external controls to turn off individual ballasts or fixtures until the selected light level is achieved. Discrete dimming approaches, however, only provide a finite number of predefined lighting levels and transitions between these discrete levels are often perceptible by users. Some continuous dimming designs operate multiple lamps in series with the power applied to the lamps being reduced for dimming. Series-connected dimming ballasts, however, suffer from inability to produce light when one or more lamps fail. Other proposed approaches include varying a DC bus amplitude via pulse width modulation (PWM) control to power a voltage or current fed inverter for driving one or more lamps, but this dimming control technique adds cost and may not provide the desired amount of dimming for certain applications. Also, continuous dimming techniques can cause early cathode failure by dimming a lamp if no separate cathode heating power is provided to keep the cathode operating within its normal temperature range. However, separate cathode heating contributes to inefficiency at dimming levels below a critical arc power level since the cathode heating power supply loss is in addition to the fact that the lamp light output is not linearly proportional to the lamp power (i.e. it may take 75% lamp power to provide 50% lamp lumens.) Thus, conventional continuous dimming techniques can lead to premature lamp degradation or failure through undesirable lamp cooling and/or extinguishment unless additional cost is incurred for cathode heating to prevent premature lamp degradation caused by the dimming operation. Continuous dimming ballasts, moreover, suffer from reduced power efficiency. Thus, there is a need for improved fluorescent lamp dimming apparatus and techniques for efficiently providing varying lighting levels to match a desired lighting level while maintaining high efficiency and without lamp stress or damage or increased cost, thereby allowing a user to selectively achieve energy savings by dimming lighting installations.

SUMMARY OF THE DISCLOSURE

Multi-lamp dimming ballasts and control methods are disclosed by which one or more of the above-mentioned deficiencies can be mitigated or overcome in driving fluorescent lamps.

Dimming ballast embodiments are presented for operating multiple lamps, which include a DC power source receiving AC input power and providing DC electrical power, as well as a DC-AC converter that provides an AC output to drive the lamps and a controller operative to control power applied to the lamps. The controller implements dimming operation according to a dimming level setpoint by selectively dimming at most one of the lamps while controlling all the remaining lamps to be substantially at 0% or 100% power. The ballast may further provide a cathode heating circuit to selectively heat one or more cathodes of the lamp being dimmed according to the setpoint dimming level.

In one embodiment, the controller selectively dims only a predetermined lamp while controlling all the remaining lamps to be substantially full on or off, so as to economize on cathode heating apparatus and dimming circuitry. In other embodiments, the controller selects one of the lamps for dimming operation and selectively dims only the selected lamp while controlling all the remaining lamps to be substantially on or off, where the selection can be by an algorithm such as random selection or round-robin selection in various embodiments. Certain embodiments of the ballast may provide a separate inverter for controlling the dimmed lamp, and may include a dedicated inverter to power each lamp. Further embodiments provide dimming at multiple predetermined levels according to the dimming level setpoint, where the controller selectively dims the selected lamp slowly in concert with selectively turning one or more of the other lamps on or off in order to smoothly transition between predetermined levels.

Methods are disclosed for powering fluorescent lamps, including receiving a dimming level setpoint value or signal indicating a desired dimming level for the dimming ballast, and selectively dimming at most one of the lamps while controlling all the remaining lamps to be substantially at 0% or 100% power at least partially according to the dimming level setpoint. Embodiments of the method may further include receiving the dimming level setpoint value or signal indicating a desired one of a plurality of predetermined discrete levels for the dimming ballast, as well as dimming at most one of the lamps slowly in concert with selectively turning one or more of the other lamps on or off so as to smoothly transition between predetermined levels.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
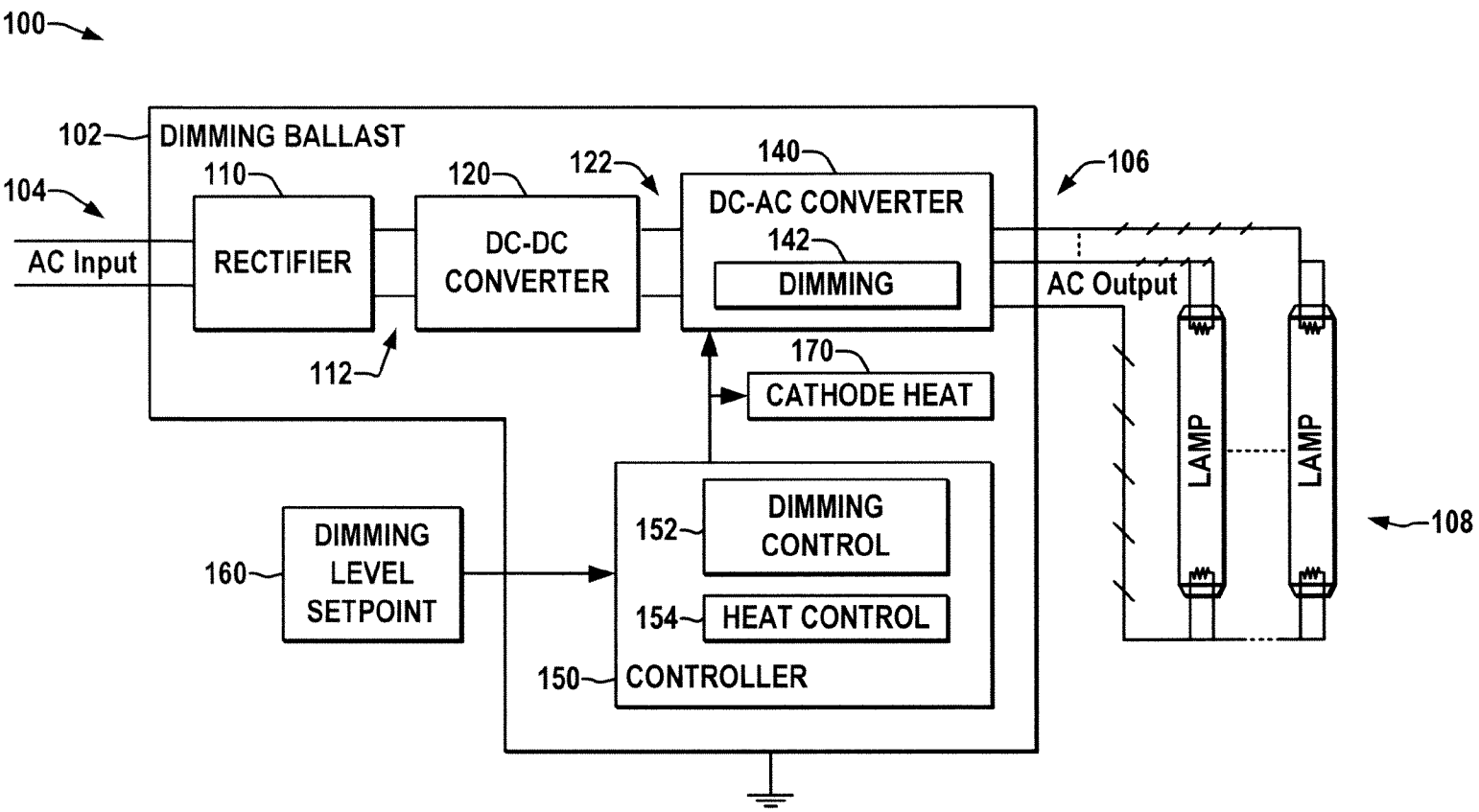
FIG. 1 is a schematic diagram illustrating an exemplary four-lamp dimming ballast with a controller that selectively dims at most one lamp while controlling all the remaining lamps to be substantially fully on or off based on a dimming level setpoint.

Referring now to the drawings, where like reference numerals are used to refer to like elements throughout, and wherein the various features are not necessarily drawn to scale, FIG. 1 illustrates a lighting system 100 including an exemplary dimming ballast 102 with a DC power source including a rectifier 110 and a DC-DC converter 120 to receive AC power at an input 104 and to provide DC electrical power 122 to a DC-AC converter 140. The DC-AC converter 140 converts the DC power 122 to provide an AC output 106 driving two or more lamps 108. The rectifier 110 in the illustrated embodiment receives the input AC 104 and provides an intermediate DC 112 to the converter 120, which is a switching type DC-DC converter 120 in one implementation, where the converter 120 can be a boost converter with a power factor correction (PFC) component 121 to also control the power factor of the ballast 102. In other possible embodiments, the intermediate DC-DC converter can be omitted.

The ballast 102 includes a controller 150 operatively coupled with the DC-AC converter 140 to control power applied to the lamps 108, and may also provide control signals to a dimming circuit 142 of the DC-AC converter 140, as well as to a cathode heating circuit 170 for selective heating of one or more lamp cathodes. The controller 150 can be any suitable types of hardware, software, or combinations thereof, and includes a dimming control component 152 and a heat control component 154. Controller 150 receives a dimming level setpoint 160, such as a signal or value and operates to selectively dim at most one of the lamps 108 while controlling all the remaining lamps 108 to be substantially at 0% or 100% power based at least in part on the dimming level setpoint 160. The on/off control of the other lamps 108 need not be strictly 100% and 0% of rated power, respectively, wherein the on state can be within 2-3% of rated and the off state can be up to 2-3% of rated power to constitute substantially 100% and substantially 0% as used herein.

By only dimming a single lamp at any given time, cathode heating only needs to be applied to the dimmed lamp, thereby reducing the amount of energy expended on non-lighting functions in the ballast 102. Moreover, only one of the lamps 108 is in a lower efficiency dimmed mode of operation, thereby increasing the overall efficiency of the ballast 102 compared with conventional continuous dimming approaches. In this regard, linear fluorescent lamps 108 are most energy efficient when operating near their rated power, and as the power into the lamp is reduced (e.g., during dimming), the lumens drop off faster than watts, such that the user is provided with greatly reduced light levels for only slightly reduced power consumption. The disclosed ballast 102 thus facilitates reduction in user lighting energy consumption without significant ballast cost impact. Furthermore, the ballast 102 provides continuous dimming capabilities, and thus allows finer adjustment resolution than discrete step-dimming systems.

Figure 2:
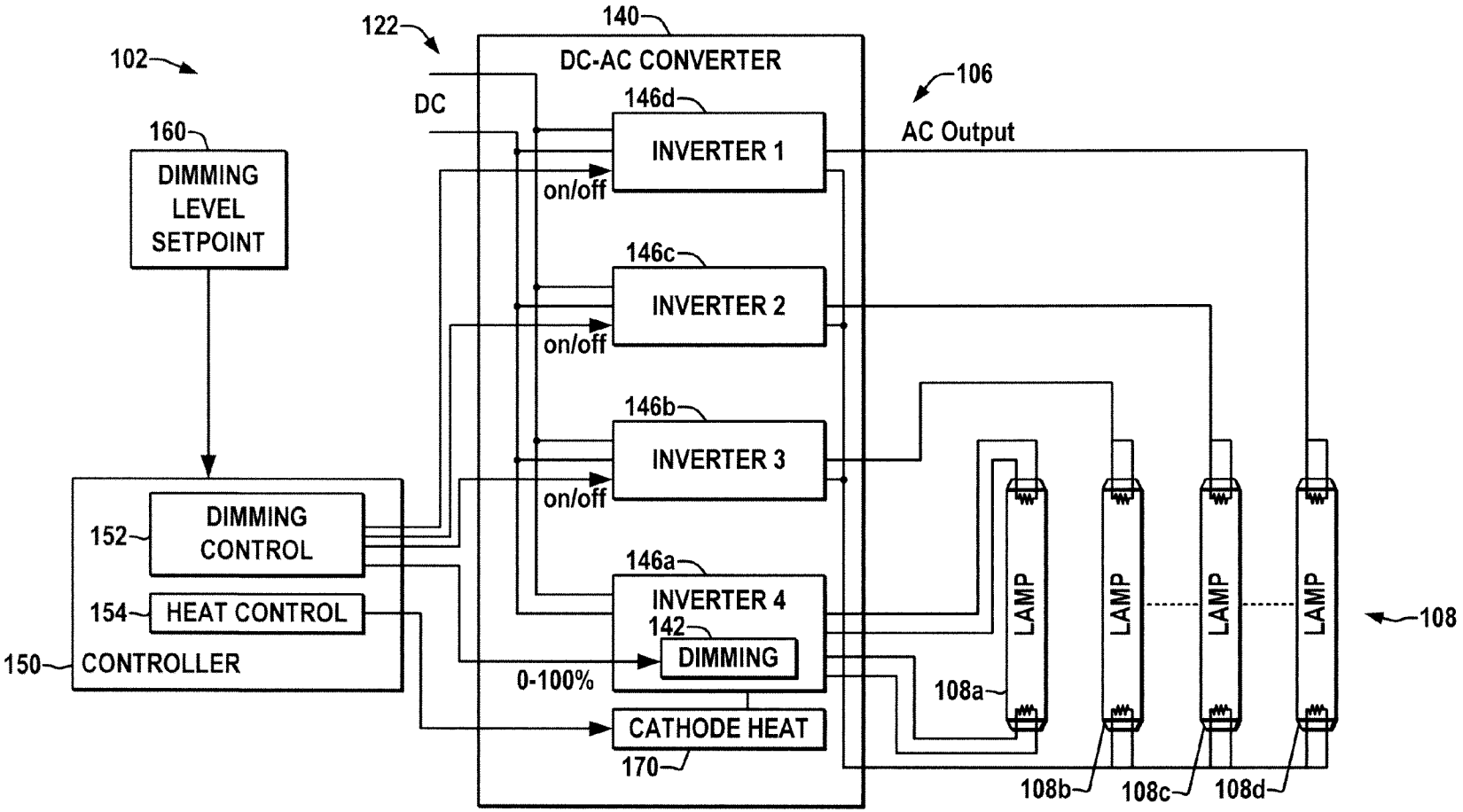
FIG. 2 is a schematic diagram illustrating further details of an embodiment of the dimming ballast of FIG. 1 in which the controller selectively dims only a predetermined lamp while controlling all the remaining lamps to be substantially full on or off with a dedicated cathode heating circuit for the predetermined lamp.

FIG. 2 illustrates an embodiment of the dimming ballast 102 in which the controller 150 selectively dims only a predetermined lamp 108*a* while controlling all the remaining lamps 108*b*, 108*c*, and 108*d* to be substantially full on or off, with a dedicated cathode heating circuit 170 for the predetermined lamp 108*a*. This embodiment provides four inverters 146*a*-146*d* individually coupled to drive lamps 108*a*-108*d*, respectively, where the inverter 146*a* associated with the predetermined dimming lamp 108*a* includes dimming circuitry 142 operative to selectively reduce the output of the inverter 146*a*, and hence reduce the light output of the lamp 108*a* based at least in part on a 0-100% signal or value from the dimming control component 152 of the controller 150. The remaining inverters 146*b*-146*d* are operated at or near 100% or 0% for on off control of the corresponding lamps 108*b*-108*d* according to on/off signals or values provided by the dimming control component 152.

The heat control component 154 of the controller 150 in this embodiment also provides a control signal or value to the cathode heating circuit 170 to selectively heat one or more cathodes of the dimming lamp 108*a* during all or a portion of the dimming operation to extend the life of the lamp 108*a*. The controller 150 may provide any suitable control signaling or messaging to the cathode heating circuit 170 to implement a heating function, which may but need not correlate with the 0-100% signal used to actuate the dimming circuit 142, where the dimming control and heat control components 152 and 154 may implement different control algorithms based on the received dimming level setpoint 160. The setpoint 160, in this regard, may be an analog signal, such as a 0-10 v DC electrical signal set by a user whose voltage level represents the desired overall ballast light output amount, or may be a digital value communicated to the controller 150, or may be any other suitable signal or value that indicating the desired light level. The controller 150 may be implemented as a processor-based system having a microprocessor, microcontroller, or other programmable or configurable processing or logic components, and the controller 150 and the components 152, 154 thereof can be implemented in software, firmware, or combinations of various hardware, software, firmware, etc., in a single control device 150 or in distributed fashion with one or more functions being implemented separately from others.

In operation, the controller 150 receives the setpoint 160 and determines the on or off status of inverters 146*b*-146*d* based on the setpoint 160 to be at or below the desired light output value, and determines the amount of dimming for the inverter 146*a* to set the overall output of the ballast 102 to meet the setpoint amount. In this regard, for a given non-zero setpoint 160, the controller 150 will provide the dimming control signals via component 152 so that all, some, or none of the inverters 146*b*-146*d* are on, and will control the dimming circuitry 142 so that the first inverter 146*a* powers the corresponding predetermined lamp 108*a* at 0-100% of its rated output. For example a dimming setpoint 160 having a value in the range of 75 to 100% light output, the controller 150 will dim the lamp 108*a* as needed to achieve that average light level while holding the other inverters 146*b*-146*d* on. For a desired setpoint of 75% light level, the inverter 146*a* is off (0%) with the other inverters 146*b*-146*d* on. For a setpoint between 50 and 75%, one of the three lamps 108*b*-108*d* is turned off, and the lamp 108*a* is dimmed to a level so that the average light level from the entire fixture is equal to the setpoint value. For the fully dim (0%) to 25% range of the setpoint 160, the controller 150 turns the inverters 146*b*-146*d* off and operates the dimming circuit 142 to drive the lamp 108*a* between its full-bright and dimmest level.

In this manner, the ballast 102 can achieve continuous dimming at any value of the setpoint 160 by selectively dimming only the lamp 108*a* while individually controlling all the remaining lamps 108*b*-108*d* to be substantially at 0% or 100% power. Other embodiments are possible in which two or more of the lamps 108*b*-108*d* are driven by a shared inverter with on/off control. For example, a single inverter 146 could drive lamps 108*c* and 108*d* with on/off capability controlled by the dimming component 152, with another on/off controlled inverter 146 driving the lamp 108*b* and the dimming-capable inverter 146*a* driving the predetermined lamp 108*a* with selective cathode heating being provided for the lamp 108*a* via the heat control component 154 and the heating circuitry 170. In other possible implementations, the cathode heating circuit 170 can be operable to selectively heat one or more cathodes of more than one of the lamps 108. Moreover, the controller 150 in the embodiment of FIG. 2 may be configured to provide dimming at a plurality of predetermined discrete levels according to the dimming level setpoint 160 (e.g. discrete dimming) and the controller (150) selectively dims the predetermined lamp 108*a* slowly in concert with selectively turning one or more of the other lamps 108*b*-108*d* on or off so as to smoothly transition between predetermined levels.

FIGS. 3-16 illustrate another dimming ballast embodiment 102 (FIG. 3) in which the controller 150 selects one of the lamps 108 for dimming operation and selectively dims only the selected lamp 108 while controlling all the remaining lamps 108 to be substantially on or off. In this implementation, the DC-AC converter 140 includes four individually dimmable inverters 146*a*-146*d*, each having dimming circuitry 142 that receives a 0%-100% control signal or value from the dimming control component 152 of the controller 150. Moreover, the cathode heating circuitry 170 in this embodiment provides cathode heating circuits for each lamp 108 that are separately controllable. The dimming control component 152 of the controller 150 selects one of the lamps 108 for dimming operation at any given time and selectively dims only the selected lamp 108 while controlling all the remaining lamps 108 to be substantially at 0% or 100% power at least partially according to the dimming level setpoint 160. Any suitable selection algorithm or scheme can be employed, preferably to distribute the dimming operation time among the lamps 108*a*-108*d*, such as random selection or round-robin selection, for example.

Figure 3:
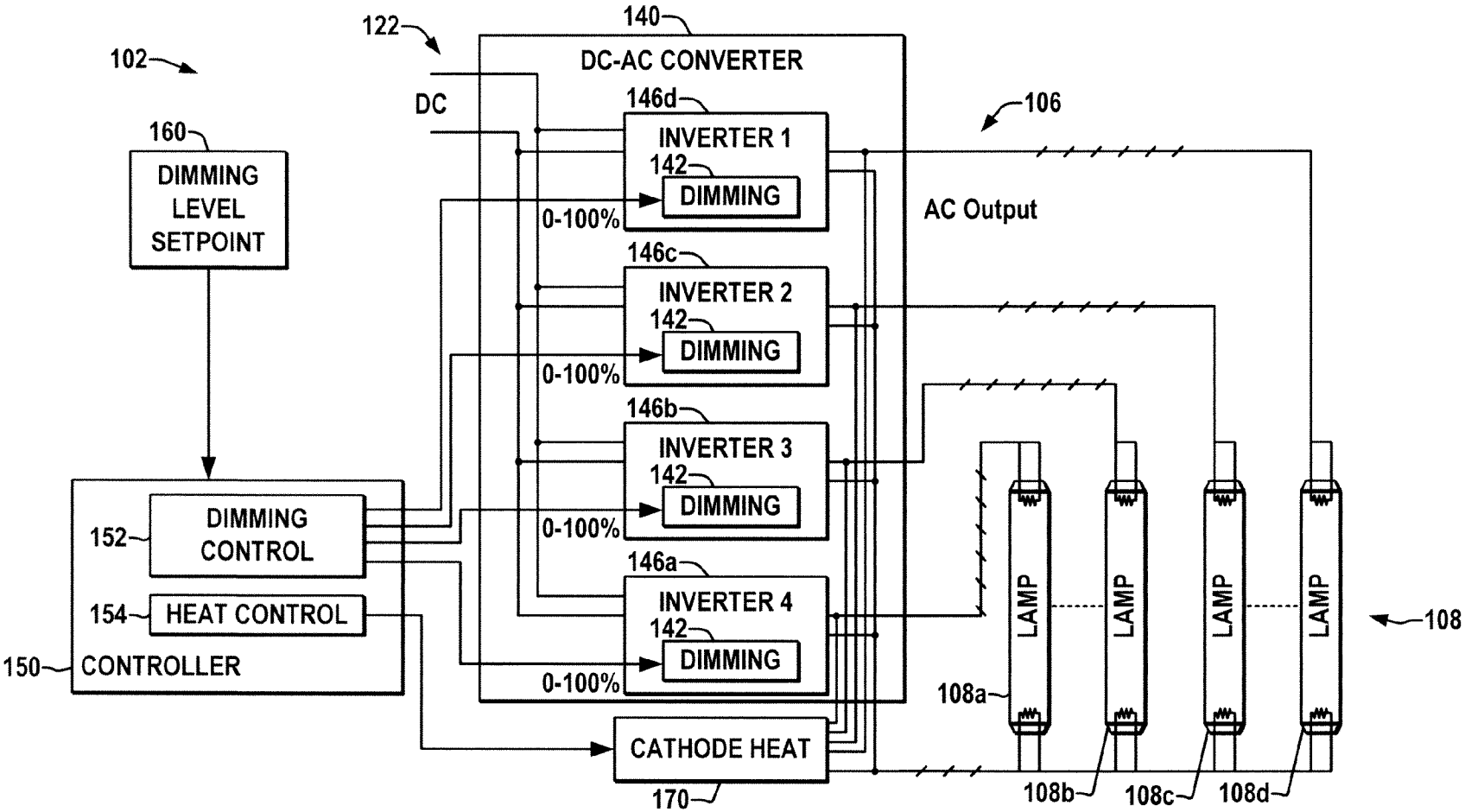
FIG. 3 is a schematic diagram illustrating further details of another dimming ballast embodiment in which the controller selects one of the lamps for dimming operation and selectively dims only the selected lamp while controlling all the remaining lamps to be substantially on or off, including individual dimmable inverters and cathode heating circuits for each lamp.
Figure 4:
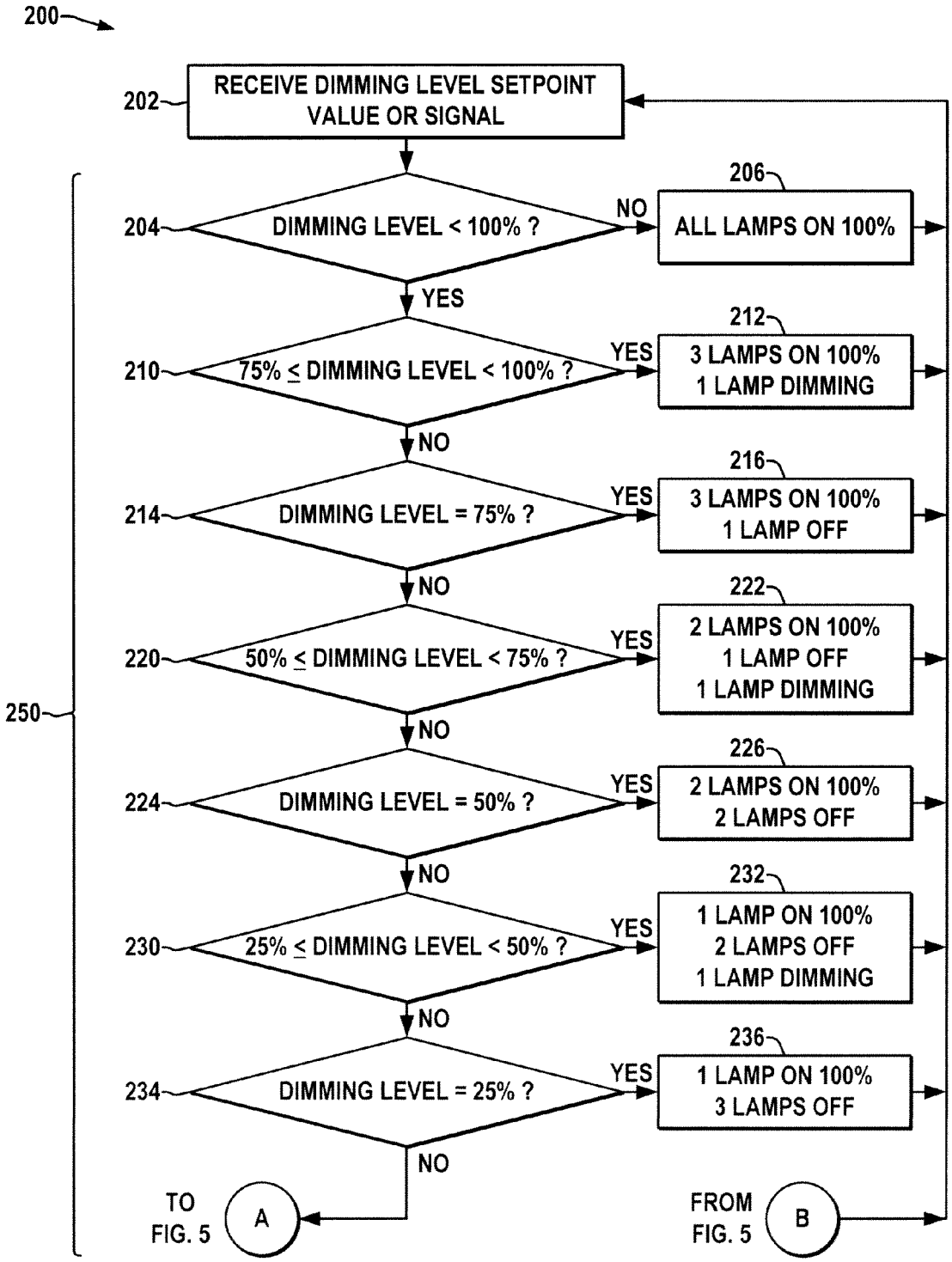
FIGS. 4 and 5 provide a flow diagram illustrating an exemplary method for powering fluorescent lamps.
Figure 5:
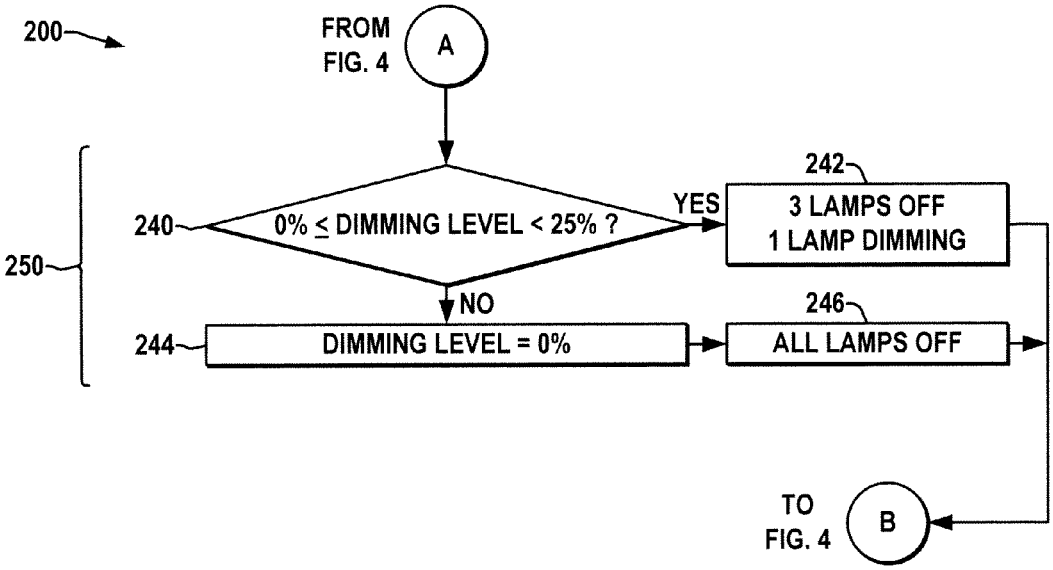
Figure 6:
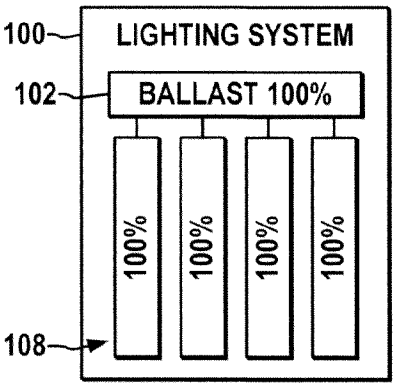
FIGS. 6-16 are simplified schematic diagrams illustrating operation of the ballast embodiment of FIGS. 1 and 3 for dimming at various exemplary levels.
Figure 7:
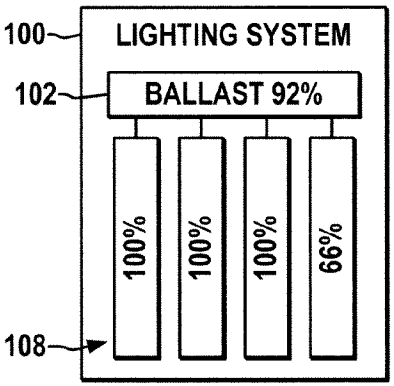
Figure 8:
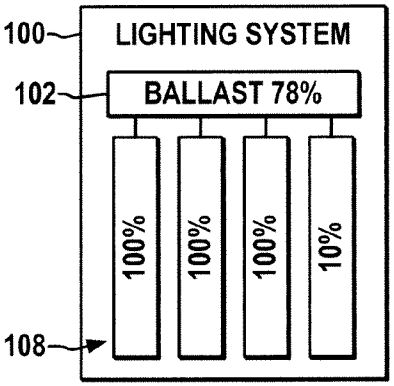
Figure 9:
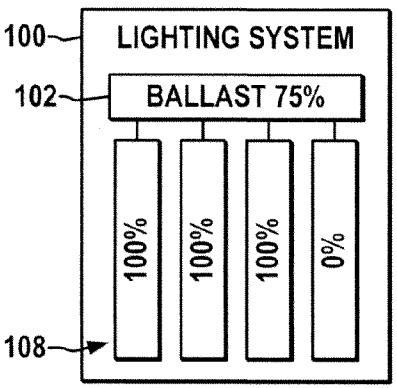
Figure 10:
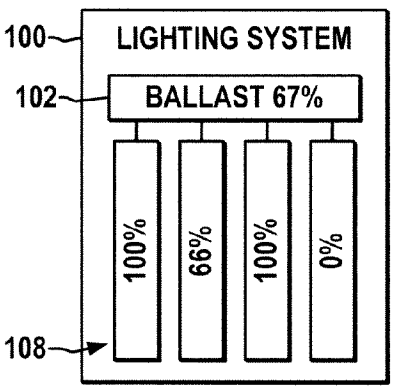
Figure 11:
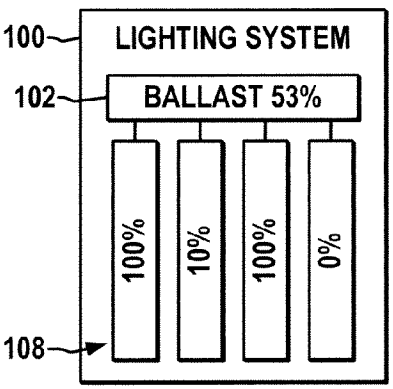
Figure 12:
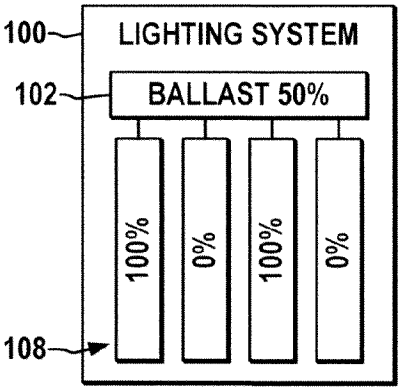
Figure 13:
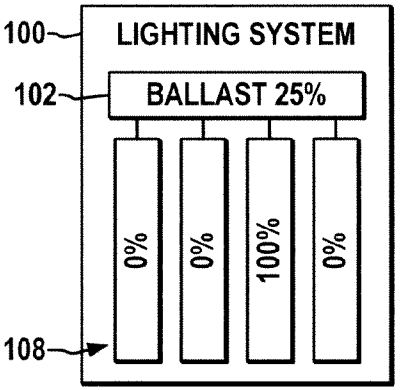
Figure 14:
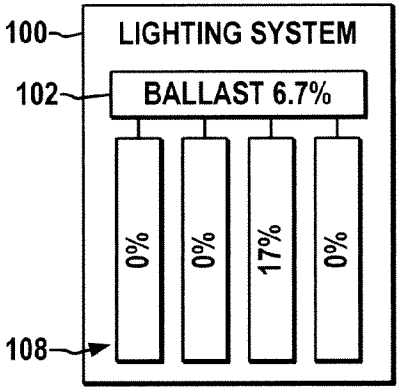
Figure 15:
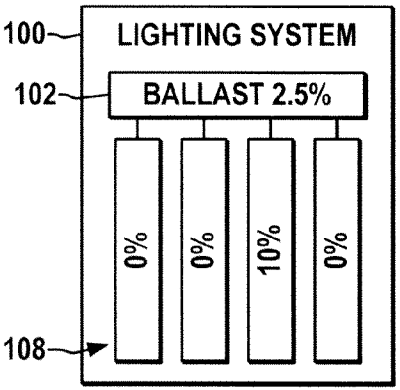
Figure 16:
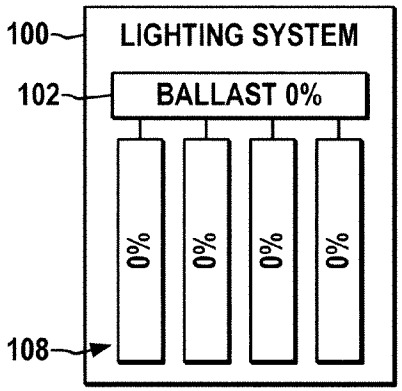

FIGS. 4 and 5 depict a flow diagram illustrating an exemplary method 200 for powering fluorescent lamps, which may be implemented by the controller 150 in the ballasts 102 illustrated and described herein, and FIGS. 6-16 illustrate operation of the ballast 102 of FIGS. 1 and 3 for dimming at various exemplary levels of the setpoint 160. While the method 200 is illustrated and described below in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, such as in the exemplary controller 150 above, in order to provide the selective dimming control concepts illustrated and described herein.

The method 200 begins in FIG. 4 with receipt at 202 of a dimming level setpoint value or signal (e.g., setpoint 160 above) indicating a desired dimming level for the dimming ballast 102. Selective dimming is then performed at 250 of at most one of the lamps 108 while controlling all the remaining lamps 108 to be substantially at 0% or 100% power at least partially according to the dimming level setpoint 160 received at 202. In the example of FIG. 4, a determination is made at 204 as to whether the setpoint dimming level is less than 100%. If not (NO at 204), all lamps are turned on at 206 (exemplary ballast condition shown in FIG. 6), and the process 200 returns to receive another setpoint at 202. If the dimming level is below 100% (YES at 204), a determination is made at 210 as to whether the dimming level is between 75% and 100%. If so, three lamps are turned on and 1 lamp is dimmed at 212 (exemplary ballast conditions shown in FIGS. 7 and 8) and the process 200 returns to receive another setpoint at 202. However, if the dimming level is not between 75% and 100% (NO at 210), a determination is made at 214 as to whether the dimming level equals 75%. If so (YES at 214), three lamps are turned on and the other lamp is turned off at 216 (ballast condition shown in FIG. 9) and the process 200 returns to receive another setpoint at 202. If not (NO at 214), a determination is made at 220 as to whether the dimming level is between 50% and 75%. If so, two lamps are turned on, 1 lamp is turned off, and one lamp is dimmed at 222 (exemplary ballast conditions shown in FIGS. 10 and 11) and the process 200 returns to receive another setpoint at 202.

If not (NO at 220), a determination is made at 224 as to whether the dimming level equals 50%. If so (YES at 224), two lamps are turned on and two lamps are turned off at 226 (FIG. 12) and the process 200 returns to receive another setpoint at 202. If the level is not equal to 50% (NO at 224), a determination is made at 230 as to whether the dimming level is between 25% and 50%, and if so, one lamp is turned on, two lamps are turned off, and 1 lamp is dimmed at 232 and the process 200 returns to receive another setpoint at 202. If the dimming level is not between 25% and 50% (NO at 230), a determination is made at 234 as to whether the dimming level is equal to 25%. If so (YES at 234), one lamp is turned on and three lamps are turned off at 236 (FIG. 13) and the process 200 returns to receive another setpoint at 202. If the dimming level does not equal 25% (No at 234), the process 200 continues to FIG. 5 with a determination being made at 240 as to whether the dimming level is between 0% and 25%. If so, three of the lamps are turned off and 1 lamp is dimmed at 242 (exemplary ballast conditions shown in FIGS. 14 and 15) and the process 200 returns to receive another setpoint at 202 in FIG. 4. If not (NO at 240 in FIG. 5), the dimming level is determined to be 0% at 244 and all lamps are turned off at 246 (FIG. 16), after which the process 200 returns to 202 in FIG. 4 to receive another setpoint 160.

Other embodiments of the method 200 are possible in which cathode heating is selectively provided to one or more cathodes of the lamp 108 being dimmed. In certain embodiments, moreover, receiving the dimming level setpoint value or signal at 202 may include receiving the dimming level setpoint value or signal 160 indicating a desired one of a plurality of predetermined discrete levels for the dimming ballast 102. In this embodiment, the selective dimming at 250 may include selectively dimming at most one of the lamps 108 slowly in concert with selectively turning one or more of the other lamps 108 on or off so as to smoothly transition between predetermined levels.

The exemplary ballasts 102 and method 200 facilitates maintenance of high fixture efficiency while not causing abrupt light level changes associated with conventional continuous and discrete dimming techniques. Various embodiments, moreover, provide for selective application of power to heat the cathodes of the dimmed lamps 108 in order to allow the dimmed lamp to operate to its rated life. The embodiments of FIG. 3, moreover, allows the controller 150 to vary which lamp which is dimmed for different light levels in order to even out any possible system effects on lamp life. These techniques, individually or in combination, provide for reduction in energy consumed by the ballast 102 compared to conventional dimming ballasts, and may further mitigate or avoid quick transients in lighting level when the dimming setpoint value is changed.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. Although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. However, modifications and alterations will occur to others upon reading and understanding the preceding detailed description. It is intended that the invention be construed as including all such modifications and alterations.

The following is claimed:

1. A dimming ballast for operating a plurality of lamps, comprising:

a DC power source operative to provide DC electrical power;

a DC-AC converter coupled to receive the DC electrical power from the DC power source and operative to provide an AC output to drive a plurality of lamps;

a controller operatively coupled with the DC-AC converter to control power applied to the lamps, the controller being operative at least partially according to a dimming level setpoint to selectively dim at most one of the lamps while controlling all the remaining lamps to be substantially at 0% or 100% power;

wherein the controller is operative to selectively dim only a predetermined one of the plurality of lamps while controlling all the remaining lamps to be substantially at 0% or 100% power at least partially according to the dimming level setpoint; and wherein the DC-AC converter comprises:

a first inverter operative to drive only the predetermined one of the plurality of lamps, the first inverter including a dimming circuit operable by the controller to selectively dim the predetermined one of the plurality of lamps, and a second inverter operative to drive one or more of the remaining lamps, the second inverter having an on/off input operable by the controller to selectively control the one or more remaining lamps to be substantially at 0% or 100% power.

2. The dimming ballast of claim 1, further comprising a cathode heating circuit operative to selectively heat one or more cathodes of the one lamp that is being dimmed at least partially according to the dimming level setpoint.

3. The dimming ballast of claim 2, wherein the cathode heating circuit is operative to selectively heat one or more cathodes of more than one of the lamps.

4. The dimming ballast of claim 2, wherein the controller is operative to provide dimming at a plurality of predetermined levels according to the dimming level setpoint, and where the controller selectively dims the selected lamp slowly in concert with selectively turning one or more of the other lamps on or off so as to smoothly transition between predetermined levels.

5. The dimming ballast of claim 1, wherein the controller is operative to provide dimming at a plurality of predetermined levels according to the dimming level setpoint, and where the controller selectively dims the selected lamp slowly in concert with selectively turning one or more of the other lamps on or off so as to smoothly transition between predetermined levels.

6. The dimming ballast of claim 1, wherein the DC power source is operative to receive AC input power and to provide DC electrical power.

7. The dimming ballast of claim 1, wherein the controller is operative to selectively dim at most one of the lamps to a value greater than substantially 0% power and less than substantially 100% power while controlling all the remaining lamps to be substantially at 0% or 100% power.

* * * * *